US011118326B2

(12) United States Patent
Saigo et al.

(10) Patent No.: US 11,118,326 B2
(45) Date of Patent: Sep. 14, 2021

(54) LOADING MACHINE CONTROL DEVICE AND CONTROL METHOD

(71) Applicant: Komatsu Ltd., Tokyo (JP)

(72) Inventors: Yusuke Saigo, Tokyo (JP); Kazuhiro Hatake, Tokyo (JP)

(73) Assignee: Komatsu Ltd., Tokyo (JP)

( * ) Notice: Subject to any disclaimer, the term of this patent is extended or adjusted under 35 U.S.C. 154(b) by 0 days.

(21) Appl. No.: 16/652,735

(22) PCT Filed: Feb. 27, 2019

(86) PCT No.: PCT/JP2019/007523

§ 371 (c)(1),
(2) Date: Apr. 1, 2020

(87) PCT Pub. No.: WO2019/168015

PCT Pub. Date: Sep. 6, 2019

(65) Prior Publication Data

US 2020/0232185 A1 Jul. 23, 2020

(30) Foreign Application Priority Data

Feb. 28, 2018 (JP) ..... JP2018-034885

(51) Int. Cl.

| | |
|---|---|
| ***E02F 9/12*** | (2006.01) |
| ***E02F 9/22*** | (2006.01) |
| ***F15B 11/10*** | (2006.01) |
| ***F15B 13/02*** | (2006.01) |
| ***F15B 21/08*** | (2006.01) |
| *E02F 3/30* | (2006.01) |

(52) U.S. Cl.

CPC ..... *E02F 9/123* (2013.01); *E02F 9/2228* (2013.01); *F15B 11/10* (2013.01); *F15B 13/024* (2013.01); *F15B 21/08* (2013.01); *E02F 3/308* (2013.01); *F15B 2211/50* (2013.01)

(58) Field of Classification Search

CPC . E02F 3/439; E02F 9/123; E02F 9/205; E02F 9/2228; F15B 11/08; F15B 11/10

See application file for complete search history.

(56) References Cited

U.S. PATENT DOCUMENTS 5,159,813 A * 11/1992 Yoshimatsu ..... B66C 23/86 60/459

2016/0146230 A1 5/2016 Jung et al.

FOREIGN PATENT DOCUMENTS

| | | | |
|---|---|---|---|
| JP | 58-091960 | A | 6/1983 |
| JP | 60-036293 | A | 2/1985 |
| JP | 62-031703 | A | 2/1987 |
| JP | 63-075224 | A | 4/1988 |
| JP | 04-007295 | A | 1/1992 |
| JP | 04-041395 | A | 2/1992 |
| JP | 05-254784 | A | 10/1993 |
| JP | 10-310374 | A | 11/1998 |

* cited by examiner

*Primary Examiner* — Abiy Teka
(74) *Attorney, Agent, or Firm* — Locke Lord LLP

(57) ABSTRACT

A control device generates an operation signal for controlling a pressure of hydraulic oil on a downstream side of the swing motor in a hydraulic device based on an azimuth direction, a swing speed, and a target stopping azimuth direction of a swing body during braking of a swing motor.

7 Claims, 9 Drawing Sheets

LOADING MACHINE CONTROL DEVICE AND CONTROL METHOD

TECHNICAL FIELD

The present invention relates to a loading machine control device and a control method.

Priority is claimed on Japanese Patent Application No. 2018-034885, filed on Feb. 28, 2018, the content of which is incorporated herein by reference.

BACKGROUND ART

PTL 1 discloses a technique for predicting a moment of inertia generated by swing of a loading machine and determining an automatic stop mode from a current speed and a remaining swing angle. According to the technique described in PTL 1, the loading machine can be stopped at a target stop position regardless of a working state by predicting the moment of inertia based on the presence/absence of contents or a posture of the work equipment.

CITATION LIST

Patent Literature

[PTL 1] Japanese Unexamined Patent Application, First Publication No. S63-75224

DISCLOSURE OF INVENTION

Technical Problem

However, even when the automatic stop mode is determined when the automatic stop control is started, a stop position of a swing body does not necessarily match the target stop position. In other words, a deceleration operation predicted based on the calculation does not necessarily match the actual deceleration operation.

An objective of the present invention is to provide a loading machine control device and a control method for accurately controlling an azimuth direction in which a swing body faces when swing is stopped.

Solution to Problem

A first aspect of the present invention provides a control device of a loading machine including a hydraulic device having a swing motor that is rotated by hydraulic oil, and a relief valve that discharges the hydraulic oil when a pressure of the hydraulic oil becomes equal to or higher than a relief pressure, and a swing body that swings around a center of swing by rotation of the swing motor, the control device including: a back pressure control unit that is configured to generate an operation signal for controlling the pressure of the hydraulic oil on a downstream side of the swing motor in the hydraulic device based on an azimuth direction, a swing speed, and a target stopping azimuth direction of the swing body during braking of the swing motor; and an operation signal output unit that is configured to output the operation signal of the back pressure control unit to the hydraulic device.

Advantageous Effects of Invention

According to at least one of the aspects, it is possible to accurately control the azimuth direction in which the swing body faces when swing is stopped.

BEST MODE FOR CARRYING OUT THE INVENTION

Hereinafter, embodiments will be described with reference to the drawings.

First Embodiment

<<Configuration of Loading Machine>>

Figure 1:
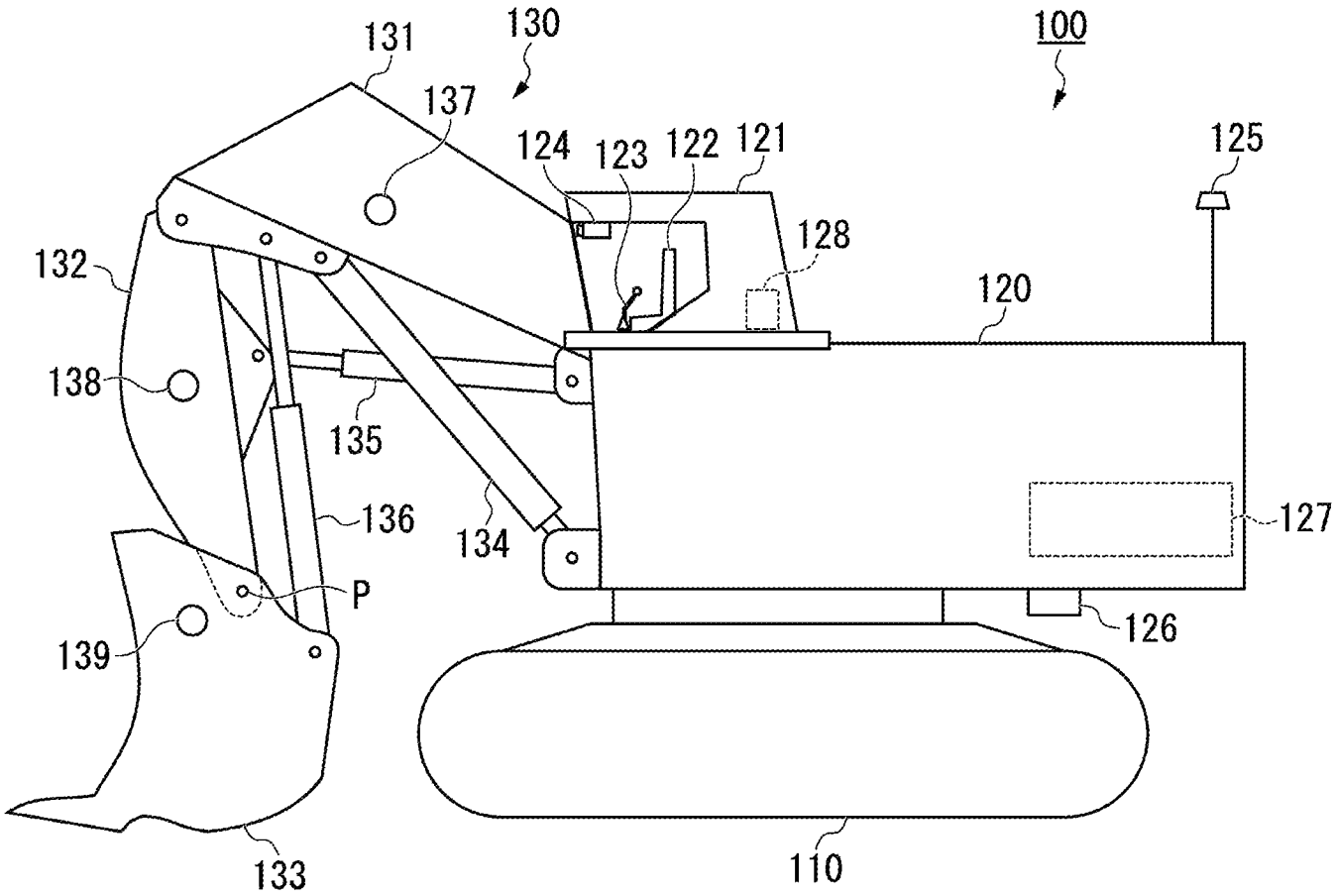
FIG. 1 is a schematic view showing a configuration of a loading machine according to a first embodiment.

FIG. 1 is a schematic view showing a configuration of a loading machine according to a first embodiment.

Figure 2:
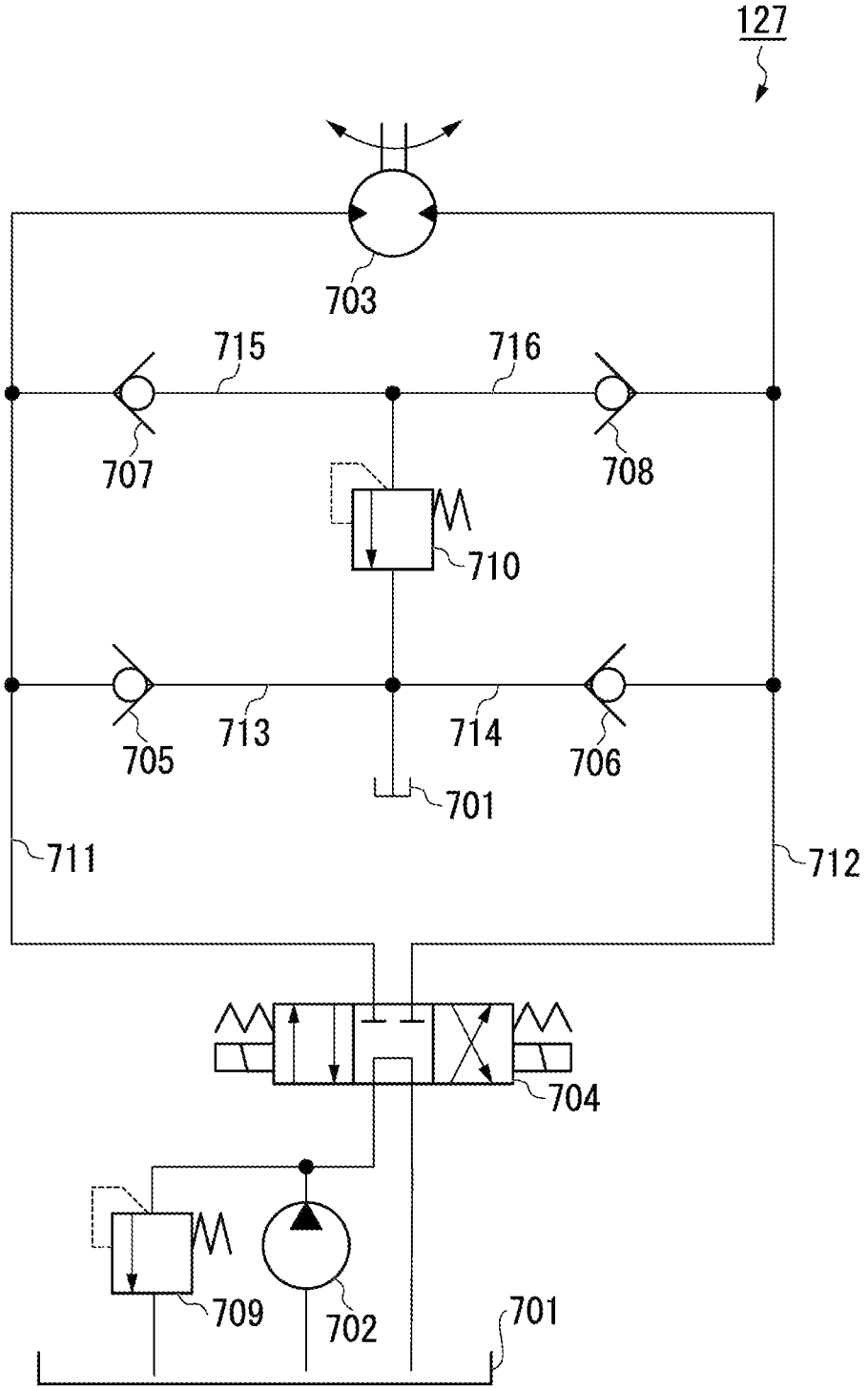
FIG. 2 is a schematic hydraulic circuit view showing a configuration that contributes to swing of a swing body in a hydraulic device according to the first embodiment.

A loading machine 100 is a work machine for loading earth onto a loading object 200, such as a transport vehicle. The loading machine 100 according to the first embodiment is a hydraulic shovel. The loading machine 100 according to another embodiment may be a loading machine 100 other than a hydraulic shovel. In addition, the loading machine 100 shown in FIG. 2 is a face shovel, but may be a backhoe shovel or a rope shovel. Examples of the loading object 200 include a transport vehicle and a hopper.

The loading machine 100 includes a traveling body 110, a swing body 120 supported by the traveling body 110, and a work equipment 130 operated by hydraulic pressure and supported by the swing body 120. The swing body 120 is supported by the traveling body 110 so as to be capable of swinging around a center of swing.

The work equipment 130 includes a boom 131, an arm 132, a bucket 133, a boom cylinder 134, an arm cylinder 135, a bucket cylinder 136, a boom angle sensor 137, an arm angle sensor 138, and a bucket angle sensor 139.

A base end portion of the boom 131 is attached to the swing body 120 via a pin.

The arm 132 connects the boom 131 and the bucket 133 to each other. A base end portion of the arm 132 is attached to a tip end portion of the boom 131 via a pin.

The bucket 133 includes a blade for excavating earth and a container for accommodating the excavated earth. A base end portion of the bucket 133 is attached to the tip end portion of the arm 132 via a pin.

The boom cylinder 134 is a hydraulic cylinder for operating the boom 131. A base end portion of the boom cylinder 134 is attached to the swing body 120. A tip end portion of the boom cylinder 134 is attached to the boom 131.

The arm cylinder 135 is a hydraulic cylinder for driving the arm 132. A base end portion of the arm cylinder 135 is attached to the boom 131. A tip end portion of the arm cylinder 135 is attached to the arm 132.

The bucket cylinder 136 is a hydraulic cylinder for driving the bucket 133. A base end portion of the bucket cylinder 136 is attached to the boom 131. A tip end portion of the bucket cylinder 136 is attached to the bucket 133.

The boom angle sensor 137 is attached to the boom 131 and detects an inclination angle of the boom 131.

The arm angle sensor 138 is attached to the arm 132 and detects an inclination angle of the arm 132.

The bucket angle sensor 139 is attached to the bucket 133 and detects an inclination angle of the bucket 133.

The boom angle sensor 137, the arm angle sensor 138, and the bucket angle sensor 139 according to the first embodiment detect the inclination angle with respect to a ground plane. In addition, the angle sensor according to another embodiment is not limited thereto, and may detect the inclination angle with respect to another reference plane. For example, in another embodiment, the angle sensor may detect a relative rotation angle with a potentiometer provided at the base end portions of the boom 131, the arm 132, and the bucket 133, or may detect the inclination angle by measuring the cylinder lengths of the boom cylinder 134, the arm cylinder 135, and the bucket cylinder 136, and by converting the cylinder length into an angle.

The swing body 120 is provided with a cab 121. Inside the cab 121, a driver seat 122 for an operator to sit on, an operation device 123 for operating the loading machine 100, and a detection device 124 for detecting a three-dimensional position of an object that exists in a detecting direction, are provided. In response to an operation of the operator, the operation device 123 generates an operation signal of the boom cylinder 134, an operation signal of the arm cylinder 135, an operation signal of the bucket cylinder 136, a swing operation signal to the left and right of the boom angle sensor 137, and a traveling operation signal for forward and backward traveling of the arm angle sensor 138 and outputs the operation signals to a control device 128. In addition, the operation device 123 generates a loading command signal for causing the work equipment 130 to start automatic loading control in accordance with the operation of the operator and outputs the loading command signal to the control device 128. The loading command signal is an example of a command to start automatic movement of the bucket 133. The operation device 123 is configured with, for example, a lever, a switch, and a pedal. The loading command signal is operated by operating a switch. For example, when the switch is pressed, a loading command signal is output. The operation device 123 is disposed in the vicinity of the driver seat 122. The operation device 123 is positioned within a range that can be operated by the operator when the operator sits on the driver seat 122.

Examples of the detection device 124 include a stereo camera, a laser scanner, and an ultra wide band (UWB) distance measuring device. The detection device 124 is provided such that the detecting direction faces the front of the cab 121 of the loading machine 100, for example. The detection device 124 specifies the three-dimensional position of the object in a coordinate system with the position of the detection device 124 as a reference.

In addition, the loading machine 100 according to the first embodiment is operated according to the operation of the operator who sits on the driver seat 122, but is not limited thereto in another embodiment. For example, the loading machine 100 according to another embodiment may be operated by a remote operation.

The loading machine 100 includes a position and azimuth direction calculator 125, an inclination measuring device 126, a hydraulic device 127, and the control device 128.

The position and azimuth direction calculator 125 calculates the position of the swing body 120 and the azimuth direction in which the swing body 120 faces. The position and azimuth direction calculator 125 includes two receivers that receive positioning signals from artificial satellites that configure a GNSS. The two receivers are installed at different positions on the swing body 120. Based on the positioning signal received by the receiver, the position and azimuth direction calculator 125 detects the position of the representative point (the origin of the shovel coordinate system) of the swing body 120 in a field coordinate system.

The position and azimuth direction calculator 125 calculates the azimuth direction in which the swing body 120 faces as a relationship between the installation position of one receiver and the installation position of the other receiver by using each positioning signal received by the two receivers. The azimuth direction in which the swing body 120 faces is a direction orthogonal to a front surface of the swing body 120 and is equal to a horizontal component of an extending direction of a straight line that extends from the boom 131 of the work equipment 130 to the bucket 133.

The inclination measuring device 126 measures an acceleration and an angular velocity of the swing body 120 and detects the posture (for example, roll angle, pitch angle, yaw angle) of the swing body 120 based on the measurement result. The inclination measuring device 126 is installed on a lower surface of the swing body 120, for example. For example, an inertial measurement unit (IMU) can be used as the inclination measuring device 126.

The hydraulic device 127 supplies hydraulic oil to a swing motor (not shown) that causes the swing body 120 to swing, a traveling motor (not shown) that causes the traveling body 110 to travel, the boom cylinder 134, the arm cylinder 135, and the bucket cylinder 136. The amount of hydraulic oil supplied from the hydraulic device 127 to the swing motor, the traveling motor, the boom cylinder 134, the arm cylinder 135, and the bucket cylinder 136 is controlled by the control device 128.

The control device 128 receives the operation signal from the operation device 123. The control device 128 drives the work equipment 130, the swing body 120, or the traveling body 110 by outputting the operation signal to the hydraulic device 127.

<<Configuration of Hydraulic Device>>

FIG. 2 is a schematic hydraulic device view showing a configuration that contributes to swing of the swing body 120 in the hydraulic device 127 according to the first embodiment.

The hydraulic device 127 includes a hydraulic oil tank 701, a hydraulic pump 702, a swing motor 703, a direction control valve 704, a first check valve 705, a second check valve 706, a third check valve 707, a fourth check valve 708, a first relief valve 709, and a second relief valve 710.

The hydraulic oil tank 701 stores hydraulic oil.

The hydraulic pump 702 is driven by a prime mover (not shown) of the loading machine 100 and transfers the hydraulic oil stored in the hydraulic oil tank 701.

The swing motor 703 is driven by the hydraulic oil supplied via a first main pipe line 711 or a second main pipe line 712, and causes the swing body 120 to swing around a center of swing.

The direction control valve 704 is provided between the hydraulic pump 702 and the swing motor 703. The direction control valve 704 and the swing motor 703 are connected to each other by the first main pipe line 711 and the second main pipe line 712. The direction control valve 704 switches a flow direction of the hydraulic oil supplied from the hydraulic pump 702. The direction control valve 704 is a 4-port 3-position solenoid valve. The direction control valve 704 switches the flow direction by driving the left and right solenoids according to the operation signal input from the control device 128 and displacing an internal spool. In a case where the spool of the direction control valve 704 is at a neutral position, the hydraulic oil is discharged to the hydraulic oil tank 701 without being supplied to the swing motor 703. When the left solenoid of the direction control valve 704 is excited by the operation signal, the hydraulic oil is supplied to the swing motor 703 via the first main pipe line 711 and discharged to the hydraulic oil tank 701 via the second main pipe line 712. Accordingly, the swing motor 703 rotates rightward. On the other hand, when the right solenoid of the direction control valve 704 is excited by the operation signal, the hydraulic oil is supplied to the swing motor 703 via the second main pipe line 712 and discharged to the hydraulic oil tank 701 via the first main pipe line 711. Accordingly, the swing motor 703 rotates leftward. Further, the opening area of the direction control valve 704 varies depending on the spool position of the direction control valve 704. Therefore, the direction control valve 704 can adjust the flow rate of the hydraulic oil according to the magnitude of the operation signal. In other words, the direction control valve 704 is a main valve that controls the flow rate of the hydraulic oil supplied to the swing motor 703.

The first check valve 705 is provided in a first branch pipe line 713 that branches from the first main pipe line 711 and is connected to the hydraulic oil tank 701. The first check valve 705 does not prevent the hydraulic oil from flowing from the hydraulic oil tank 701 to the first main pipe line 711. Accordingly, the first check valve 705 can prevent the first main pipe line 711 from being in a negative pressure state.

The second check valve 706 is provided in a second branch pipe line 714 that branches from the second main pipe line 712 and is connected to the hydraulic oil tank 701. The second check valve 706 does not prevent the hydraulic oil from flowing from the hydraulic oil tank 701 to the second main pipe line 712. Accordingly, the second check valve 706 can prevent the second main pipe line 712 from being in a negative pressure state.

The third check valve 707 is provided in a third branch pipe line 715 that branches from the first main pipe line 711 and is connected to the hydraulic oil tank 701 via the second relief valve 710. The third check valve 707 does not prevent the hydraulic oil from flowing from the first main pipe line 711 to the second relief valve 710.

The fourth check valve 708 is provided in a fourth branch pipe line 716 that branches from the second main pipe line 712 and is connected to the hydraulic oil tank 701 via the second relief valve 710. The fourth check valve 708 does not prevent the hydraulic oil from flowing from the second main pipe line 712 to the second relief valve 710.

The first relief valve 709 is provided between a discharge port of the hydraulic pump 702 and the hydraulic oil tank 701, and discharges the hydraulic oil to the hydraulic oil tank 701 when the pressure applied to the first relief valve 709 becomes equal to or higher than the set relief pressure. Accordingly, the first relief valve 709 can prevent the pressure of the hydraulic oil discharged from the hydraulic pump 702 from becoming extremely high.

The second relief valve 710 is provided between the third branch pipe line 715 and the fourth branch pipe line 716 and the hydraulic oil tank 701 and discharges the hydraulic oil to the hydraulic oil tank 701 when the pressure applied to the second relief valve 710 becomes equal to or higher than the set relief pressure. Accordingly, the second relief valve 710 can prevent the internal pressure of the first main pipe line 711 or the second main pipe line 712 from becoming extremely high. By providing the second relief valve 710, the maximum value of the braking force of the swing motor 703 corresponds to the relief pressure of the second relief valve 710.

<<Configuration of Control Device>>

The control device 128 receives the operation signal from the operation device 123. The control device 128 operates the work equipment 130, the swing body 120, or the traveling body 110 by outputting the operation signal to the hydraulic device 127.

Figure 3:
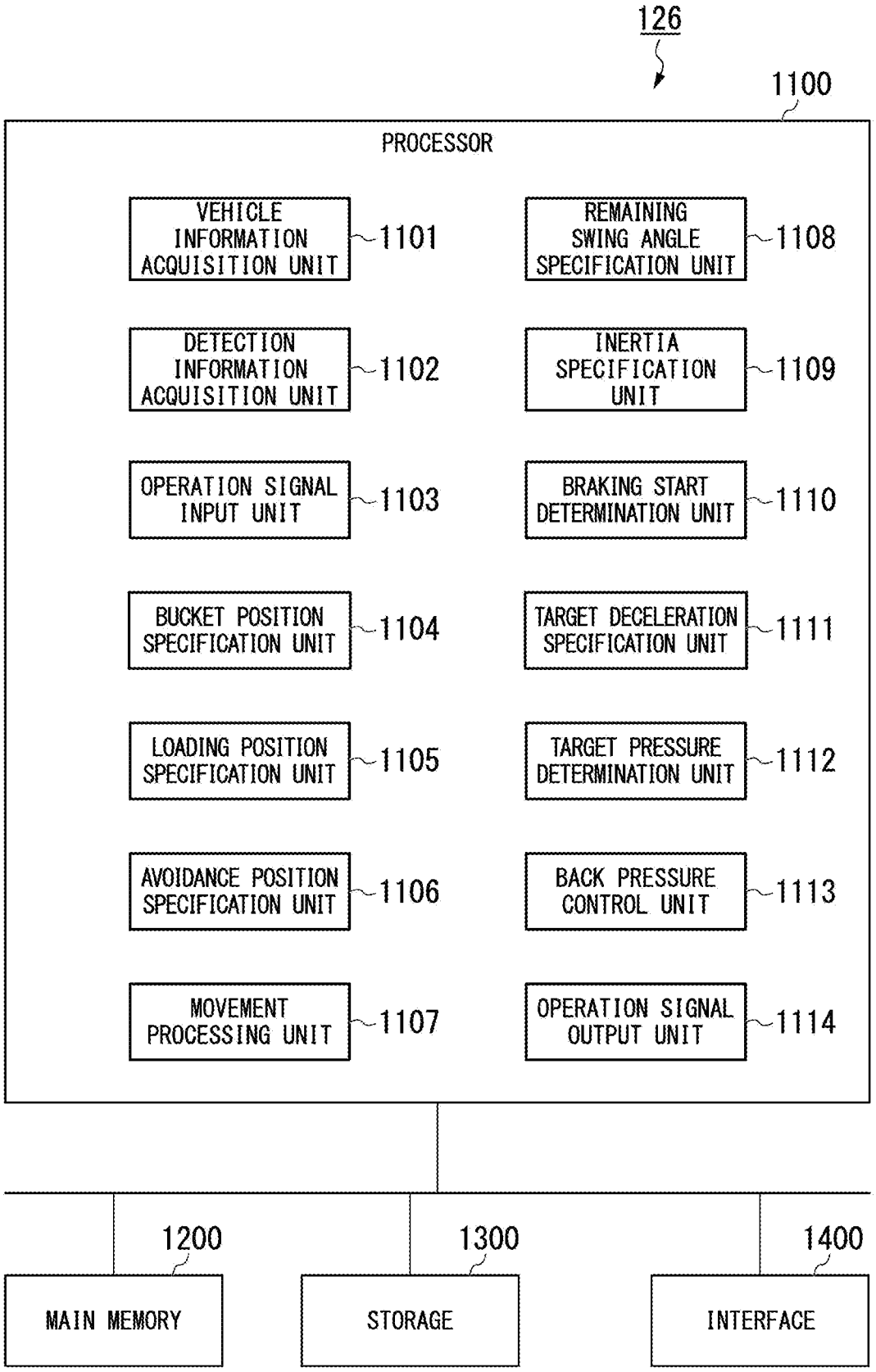
FIG. 3 is a schematic block diagram showing a configuration of a control device according to the first embodiment.

FIG. 3 is a schematic block diagram showing a configuration of the control device according to the first embodiment.

The control device 128 is a computer including a processor 1100, a main memory 1200, a storage 1300, and an interface 1400. The storage 1300 stores a program. The processor 1100 reads the program from the storage 1300, loads the program in the main memory 1200, and executes processing according to the program.

Examples of the storage 1300 include HDDs, SSDs, magnetic disks, magneto-optical disks, CD-ROMs, DVD-ROMs, and the like. The storage 1300 may be an internal medium directly connected to a common communication line of the control device 128, or may be an external medium connected to the control device 128 via the interface 1400. The storage 1300 is a tangible storage medium that is not temporary.

The processor 1100 is executed by a program and includes a vehicle information acquisition unit 1101, a detection information acquisition unit 1102, an operation signal input unit 1103, a bucket position specification unit 1104, a loading position specification unit 1105, an avoidance position specification unit 1106, a movement processing unit 1107, a remaining swing angle specification unit 1108, an inertia specification unit 1109, a braking start determination unit 1110, a target deceleration specification unit 1111, a target pressure determination unit 1112, a back pressure control unit 1113, and an operation signal output unit 1114.

The vehicle information acquisition unit 1101 acquires the swing speed, the position, and the azimuth direction of the swing body 120, the inclination angles of the boom 131, the arm 132, and the bucket 133, the traveling speed of the traveling body 110, and the posture of the swing body 120. Hereinafter, information on the loading machine 100 acquired by the vehicle information acquisition unit 1101 will be referred to as vehicle information.

The detection information acquisition unit 1102 acquires three-dimensional position information from the detection device 124 and specifies the position and the shape of the loading object 200 (for example, a transport vehicle or a hopper).

The operation signal input unit 1103 receives an operation signal input from the operation device 123. A rotation operation signal of the boom 131, a rotation operation signal of the arm 132, a rotation operation signal of the bucket 133, a swing operation signal of the swing body 120, a traveling operation signal of the traveling body 110, and a loading command signal of the loading machine 100 are included.

Figure 4:
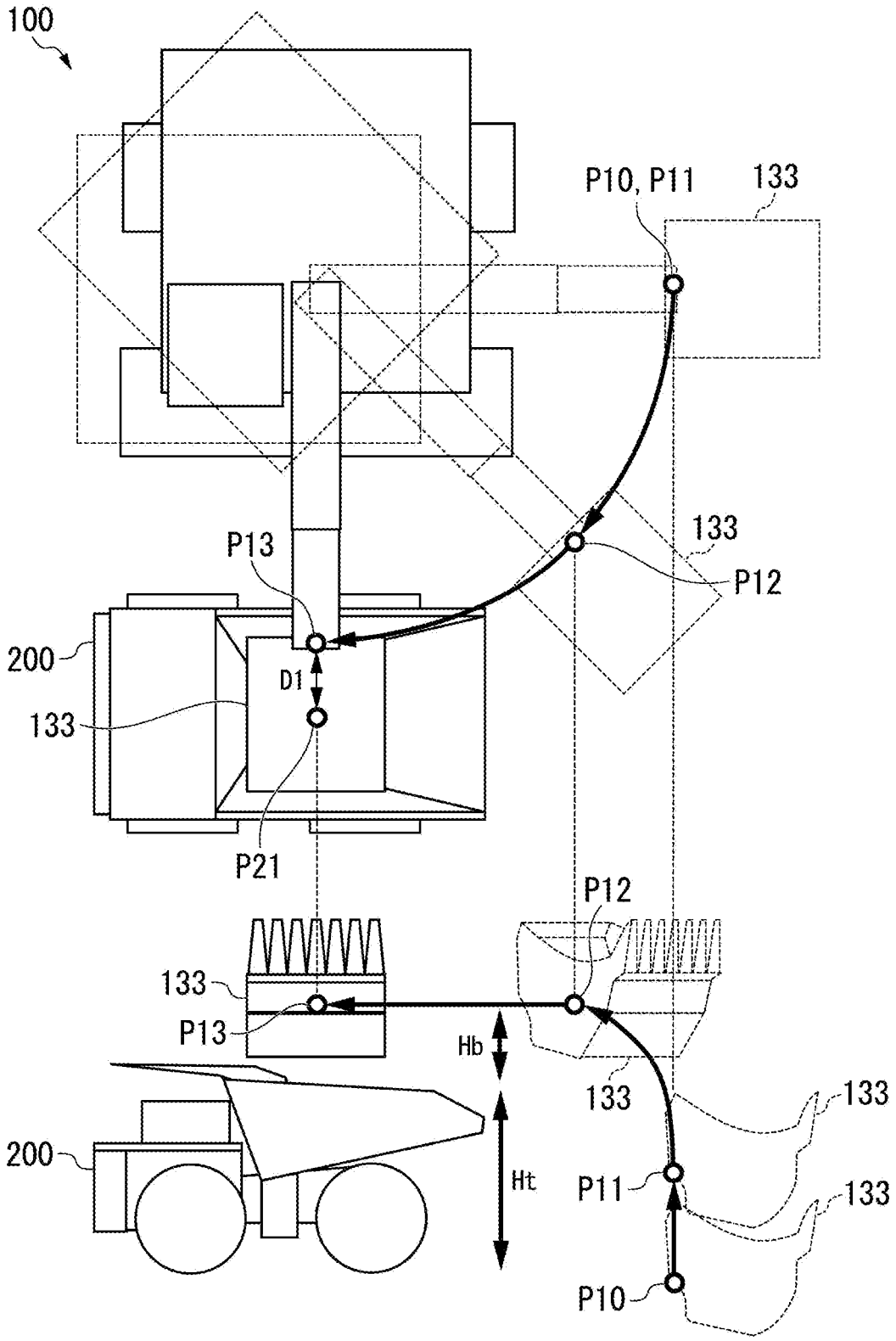
FIG. 4 is a view showing an example of a bucket path according to the first embodiment.

Based on the vehicle information acquired by the vehicle information acquisition unit 1101, the bucket position specification unit 1104 specifies a position P of the tip of the arm 132 in the shovel coordinate system and a height Hb from the tip of the arm 132 to the lowest point of the bucket 133. The lowest point of the bucket 133 means a point having the shortest distance from a ground surface in the outer shape of the bucket 133. In particular, the bucket position specification unit 1104 specifies the position P of the tip of the arm 132 when the input of the loading command signal is received as an excavation completion position P10. FIG. 4 is a view showing an example of a bucket path according to the first embodiment. Specifically, the bucket position specification unit 1104 obtains vertical direction components and horizontal direction components of the length of the boom 131 based on the inclination angle of the boom 131 and the known length (the distance from the pin of the base end portion to the pin at the tip end portion) of the boom 131. Similarly, the bucket position specification unit 1104 obtains the vertical direction components and the horizontal direction components of the length of the arm 132. The bucket position specification unit 1104 specifies a position separated from the position of the loading machine 100 by the sum of the vertical direction components and the sum of horizontal direction components of the lengths of the boom 131 and the arm 132, in the direction specified from the azimuth direction and posture of the loading machine 100, as the position P (position P of the pin of the tip end portion of the arm 132 shown in FIG. 1) of the tip of the arm 132. Further, the bucket position specification unit 1104 specifies the lowest point in the vertical direction of the bucket 133 based on the inclination angle of the bucket 133 and the known shape of the bucket 133, and specifies the height Hb from the tip of the arm 132 to the lowest point.

The loading position specification unit 1105 specifies a loading position P13 based on the position and the shape of the loading object 200 specified by the detection information acquisition unit 1102 in a case where the loading command signal is input to the operation signal input unit 1103. The loading position specification unit 1105 converts a loading point P21 indicated by the position information of the loading object 200 from the field coordinate system to the shovel coordinate system based on the position, the azimuth direction, and the posture of the swing body 120 acquired by the vehicle information acquisition unit 1101. The loading position specification unit 1105 specifies a position separated from the specified loading point P21 by a distance D1 from the center of the bucket 133 to the tip of the arm 132 in the direction in which the swing body 120 of the loading machine 100 faces, as a plane position of the loading position P13. In other words, when the tip of the arm 132 is positioned at the loading position P13, the center of the bucket 133 is positioned at the loading point P21. Therefore, the control device 128 can move the center of the bucket 133 to the loading point P21 by controlling the tip of the arm 132 to move to the loading position P13. Hereinafter, the direction in which the swing body 120 faces when the tip of the arm 132 is positioned at the loading position P13 is also referred to as a target stopping azimuth direction. The loading position specification unit 1105 specifies a height of the loading position P13 by adding the height Hb from the tip of the arm 132 specified by the bucket position specification unit 1104 to the lowest point and the height for the control margin of the bucket 133 to a height Ht of the loading object 200. In another embodiment, the loading position specification unit 1105 may specify the loading position P13 without adding the height for the control margin. In other words, the loading position specification unit 1105 may specify the height of the loading position P13 by adding the height Hb to the height Ht.

The avoidance position specification unit 1106 specifies an interference avoidance position P12 that is a point at which the work equipment 130 and the loading object 200 do not interfere with each other in a plan view from above based on the loading position P13 specified by the loading position specification unit 1105, the position of the loading machine 100 acquired by the vehicle information acquisition unit 1101, and the position and the shape of the loading object 200 specified by the detection information acquisition unit 1102. The interference avoidance position P12 has the same height as the loading position P13, the distance from the center of swing of the swing body 120 is equal to the distance from the center of swing to the loading position P13, and the interference avoidance position P12 is a position where the loading object 200 is not present therebelow. The avoidance position specification unit 1106 specifies, for example, a circle which is centered on the center of swing of the swing body 120 and the radius of which is the distance between the center of swing and the loading position P13, and specifics a position at which the outer shape of the bucket 133 does not interfere with the loading object 200 in a plan view from above among the positions on the circle and which is the closest to the loading position P13 as the interference avoidance position P12. The avoidance position specification unit 1106 can determine whether or not the loading object 200 and the bucket 133 interfere with each other based on the position and the shape of the loading object 200 and the known shape of the bucket 133. Here, "the same height" and "the distances are equal" are not necessarily limited to those in which the heights or distances completely match each other and some errors and margins are allowed.

In a case where the operation signal input unit 1103 receives the input of the loading command signal, the movement processing unit 1107 generates the operation signal for moving the bucket 133 to the loading position P13 based on the loading position P13 specified by the loading position specification unit 1105 and the interference avoidance position P12 specified by the avoidance position specification unit 1106. In other words, the movement processing unit 1107 generates the operation signal so as to reach the loading position P13 from the excavation completion position P10 via a swing start position P11 and the interference avoidance position P12. Further, the movement processing unit 1107 generates the operation signal for the bucket 133 such that a ground angle of the bucket 133 does not change even when the boom 131 and the arm 132 are driven.

The remaining swing angle specification unit 1108 specifies the remaining swing angle for stopping at the target stopping azimuth direction, from the difference between the azimuth direction in which the swing body 120 currently faces and the target stopping azimuth direction. The azimuth direction in which the swing body 120 currently faces can be obtained by updating the azimuth direction calculated by the position and azimuth direction calculator 125 based on the swing speed of the swing body 120 output by the inclination measuring device 126.

The inertia specification unit 1109 specifies the moment of inertia in the swing of the swing body 120 around the center of swing. The moment of inertia is calculated based on the postures of the boom 131, the arm 132, and the bucket 133 acquired by the vehicle information acquisition unit 1101, the shapes and the weights of the known boom 131, the arm 132, and the bucket 133, and the weight of the earth accommodated in the bucket 133. The moment of inertia may be calculated based on the pressure applied to the swing motor 703 during the acceleration of the swing body 120 and the swing speed of the swing body 120 output from the inclination measuring device 126, or a predetermined value may be used.

The braking start determination unit 1110 determines whether to start braking of the swing motor 703 based on the current swing speed and the remaining swing angle of the swing body 120. Specifically, the braking start determination unit 1110 determines to start braking of the swing motor 703 in a case where an angle at which the swing body 120 swings until stop becomes equal to or greater than the remaining swing angle when the swing motor 703 is decelerated at a deceleration that corresponds to a temporary target pressure smaller than the relief pressure of the second relief valve 710, that is, in a case where the azimuth direction in which the swing body 120 faces reaches the target stopping azimuth direction. In other words, when the braking start determination unit 1110 determines to start braking of the swing motor 703 at a timing when the swing body 120 is stopped at the target stopping azimuth direction when the pressure on the downstream side of the first main pipe line 711 and the second main pipe line 712 is maintained to the temporary target pressure that is a constant pressure after the braking is started. "Deceleration" refers to negative acceleration.

Figure 5:
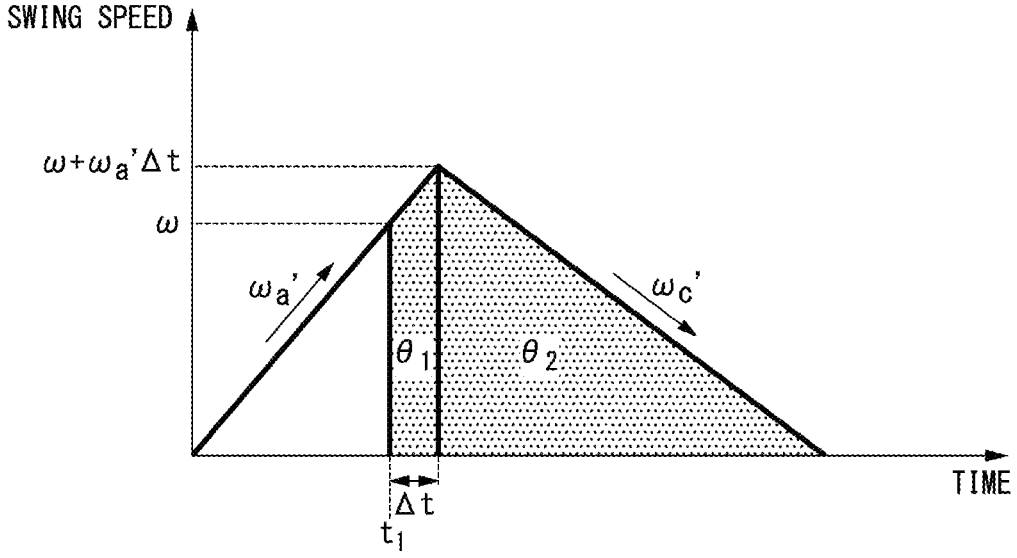
FIG. 5 is a graph showing a relationship between a swing speed of the swing body and time.

FIG. 5 is a graph showing a relationship between the swing speed of the swing body and time.

Hereinafter, an example of a procedure for specifying the angle at which the swing body 120 swings until stop when the braking start determination unit 1110 is decelerated at a deceleration that corresponds to the temporary target pressure will be described with reference to FIG. 5.

Here, an example in which the angle of swing of the swing body 120 until stop is specified in a case where braking of the swing motor 703 is started at time t1, will be described.

The braking start determination unit 1110 specifies a swing angle $\theta_1$ until the swing motor 703 switches from acceleration to deceleration after the braking signal is output, and a swing speed $\omega+\omega_a'\Delta t$ when the swing motor 703 switches from acceleration to deceleration based on a current swing speed $\omega$ of the swing body 120, an acceleration $\omega_a'$ when the opening of the direction control valve 704 is maximized, and a response delay time $\Delta t$ of the hydraulic device 127. The swing angle $\theta_1$ can be obtained based on the following equation (1).

[Equation 1]

$$\theta_1 = \left(\omega + \frac{\omega_a'\Delta t}{2}\right)\Delta t \tag{1}$$

Next, the braking start determination unit 1110 specifies a swing angle $\theta_2$ from start to stop of deceleration of the swing motor 703 based on the swing speed $\omega+\omega_a'\Delta t$ and the deceleration $\omega_c'$ that corresponds to the temporary target pressure. The swing angle $\theta_2$ can be obtained based on the following equation (2).

[Equation 2]

$$\theta_2 = \frac{(\omega + \omega_a'\Delta t)^2}{2\omega_c'} \tag{2}$$

The deceleration $\omega_c'$ corresponding to the temporary target pressure can be obtained based on the following equation (3) using a moment of inertia $J_s$, a temporary target pressure $P_p$, a capacity $q_m$ of the swing motor 703, a swing deceleration ratio $G_s$, and a mechanical loss $T_l$ of swing. In addition, the capacity $q_m$, the deceleration ratio $G_s$, and the mechanical loss $T_l$ of the swing motor 703 are known values.

[Equation 3]

$$\omega_c' = \frac{P_p q_m G_s + T_l}{J_s} \tag{3}$$

Then, the braking start determination unit 1110 specifies the sum of the swing angle $\theta_1$ and the swing angle $\theta_2$ as the angle at which the swing body 120 swings until stop.

The target deceleration specification unit 1111 specifies a target deceleration for the swing body 120 to stop in the target stopping azimuth direction based on the current swing speed of the swing body 120 and the remaining swing angle.

Hereinafter, an example of a procedure in which the target deceleration specification unit 1111 specifies the target deceleration will be described with reference to FIG. 5.

The target deceleration specification unit 1111 specifies the target deceleration in the following procedure from the output of the braking command until the swing motor 703 switches from acceleration to deceleration.

First, the target deceleration specification unit 1111 specifies the swing angle $\theta_2$ to swing from the start to the stop of deceleration of the swing motor 703 such that the swing body 120 is stopped in the target stopping azimuth direction, by subtracting the swing angle $\theta_1$ specified by the braking start determination unit 1110 from the remaining swing angle $\theta_0$ specified by the remaining swing angle specification unit 1108.

The target deceleration specification unit 1111 specifies a target deceleration cot based on a swing speed $\omega+\omega_a'\Delta t$ when the swing motor 703 switches from acceleration to deceleration and the swing angle $\theta_2$ to swing. The target deceleration cot can be obtained based on the following equation (4).

[Equation 4]

$$\omega_t' = \frac{(\omega + \omega_a'\Delta t)^2}{2\theta_2} \tag{4}$$

On the other hand, the target deceleration specification unit 1111 specifies the target deceleration $\omega_t'$ based on the current speed $\omega$, the remaining swing speed $\theta_0$, and the following equation (4') after the timing when the swing motor 703 switches from acceleration to deceleration.

[Equation 5]

$$\omega_t' = \frac{\omega^2}{2\theta_0} \tag{4'}$$

The target pressure determination unit 1112 determines a target pressure $P_c$ of the hydraulic oil on the downstream side of the swing motor 703 of the hydraulic device 127 for achieving the target deceleration $\omega_t'$, based on the target deceleration $\omega_t'$. For example, the target pressure determination unit 1112 determines the target pressure $P_c$ based on the following equation (5). The target pressure $P_c$ determined by the target pressure determination unit 1112 does not necessarily match the temporary target pressure $P_p$.

[Equation 6]

$$P_c = \frac{J_s\omega_t' - T_l}{q_m G_s} \tag{5}$$

Based on the target pressure $P_c$, the back pressure control unit 1113 obtains the opening area A on the downstream side of the swing motor 703 of the direction control valve 704 for achieving the target pressure $P_c$ and generates the operation signal for controlling the opening area of the direction control valve 704. For example, the back pressure control unit 1113 determines the opening area A based on the following equation (6).

[Equation 7]

$$Q = CA\sqrt{P_c - P_0} \tag{6}$$

Here, a value Q represents the flow rate of the hydraulic oil that flows through the direction control valve 704. The flow rate of the hydraulic oil can be obtained from the swing speed measured by the inclination measuring device 126 or the rotation speed of the swing motor 703. A coefficient C represents a flow coefficient when the opening of the direction control valve 704 is regarded as an orifice. The flow coefficient C is a value that compensates for the difference in shape between the orifice and the opening of the direction control valve 704. A value $P_0$ is a pressure on the hydraulic oil tank 701 side of the direction control valve 704. The back pressure control unit 1113 may calculate the pressure $P_0$ as 0.

At this time, the back pressure control unit 1113 may determine the opening area A in view of a value obtained by multiplying a feedback gain that corresponds to a response delay to a difference between the target pressure and the hydraulic oil pressure on the downstream side of the swing motor 703 of the actual hydraulic device 127.

The operation signal output unit 1114 outputs the operation signal input to the operation signal input unit 1103, the operation signal generated by the movement processing unit 1107, or the operation signal generated by the back pressure control unit 1113 to the hydraulic device 127. Specifically, the operation signal output unit 1114 outputs the swing operation signal generated by the movement processing unit 1107 in a case where the automatic loading control is being performed and the swing body 120 is being accelerated, outputs the swing operation signal generated by the back pressure control unit 1113 in a case where the automatic loading control is being performed and the swing body 120 is being decelerated, and outputs the swing operation signal generated by the operation signal input unit 1103 in a case where the automatic loading control is not being performed. In addition, the operation signal output unit 1114 outputs the swing operation signal generated by the movement processing unit 1107 in a case where the automatic loading control is being performed, and outputs the swing operation signal generated by the operation signal input unit 1103 in a case where the automatic loading control is not being performed.

<<Operation>>

When the operator of the loading machine 100 determines that the loading machine 100 and the loading object 200 are in a positional relationship that allows loading processing, the operator switches on the operation device 123. Accordingly, the operation device 123 generates and outputs a loading command signal.

Figure 6:
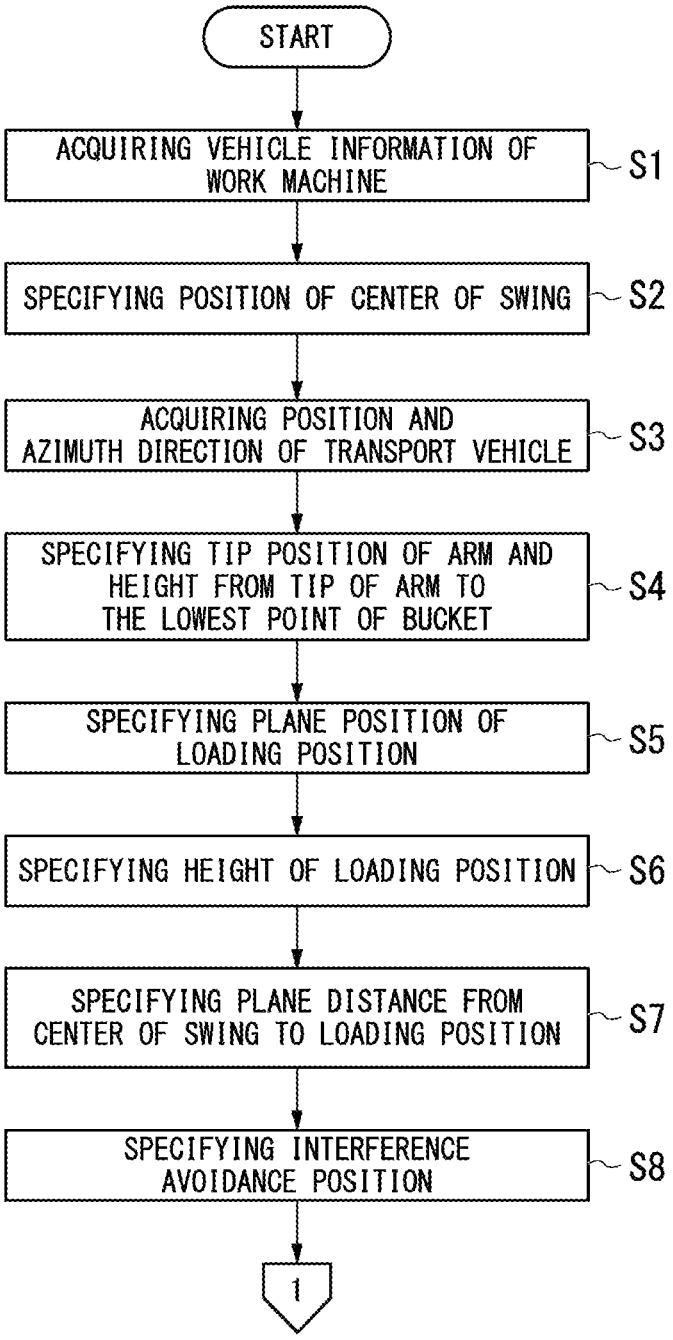
FIG. 6 is a flowchart showing an automatic loading control method according to the first embodiment.
Figure 7:
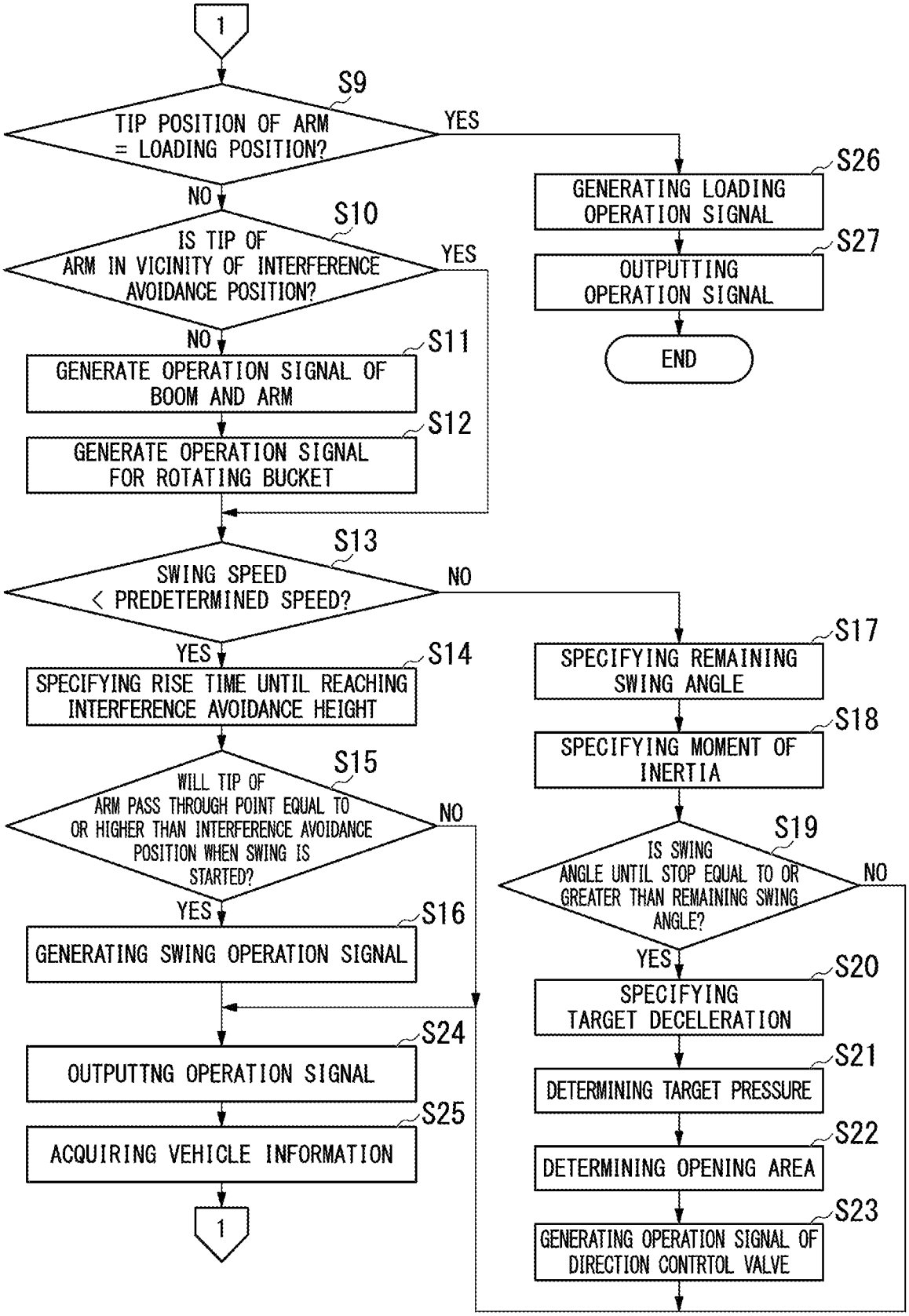
FIG. 7 is a flowchart showing the automatic loading control method according to the first embodiment.

FIGS. 6 and 7 are flowcharts showing an automatic loading control method according to the first embodiment. When the control device 128 receives the input of the loading command signal from the operator, the control device 128 executes the automatic loading control shown in FIGS. 6 and 7.

The vehicle information acquisition unit 1101 acquires the position and the azimuth direction of the swing body 120, the inclination angles of the boom 131, the arm 132, and the bucket 133, the posture and the swing speed of the swing body 120 (step S1). The bucket position specification unit 1104 specifies the position of the center of swing of the swing body 120 based on the position and the azimuth direction of the swing body 120 acquired by the vehicle information acquisition unit 1101 (step S2). Then, the detection information acquisition unit 1102 acquires the three-dimensional position information of the loading object 200 from the detection device 124 and specifies the position and the shape of the loading object 200 from the three-dimensional position information (step S3).

Based on the vehicle information acquired by the vehicle information acquisition unit 1101, the bucket position specification unit 1104 specifies the position P of the tip of the arm 132 when the loading command signal is input, and the height from the tip of the arm 132 to the lowest point of the bucket 133 (step S4). The bucket position specification unit 1104 specifies the position P as the excavation completion position P10.

The loading position specification unit 1105 converts the position information of the loading object 200 acquired by the detection information acquisition unit 1102 from the field coordinate system to the shovel coordinate system based on the position, the azimuth direction, and the posture of the swing body 120 acquired in step S1. The loading position specification unit 1105 specifies the plane position of the loading position P13 based on the position and the shape of the loading object 200 specified by the detection information acquisition unit 1102 (step S5). At this time, the loading position specification unit 1105 specifies the height of the loading position P13 by adding the height Hb from the tip of the arm 132 specified in step S4 to the lowest point of the bucket 133 and the height for the control margin of the bucket 133, to the height Ht of the loading object 200 (step S6).

The avoidance position specification unit 1106 specifies the plane distance from the center of swing to the loading position P13 (step S7). The avoidance position specification unit 1106 specifies the position separated from the center of swing by the specified plane distance, that is, the position at which the outer shape of the bucket 133 does not interfere with the loading object 200 in a plan view and which is the closest to the loading position P13, as the interference avoidance position P12 (step S8).

The movement processing unit 1107 determines whether or not the position of the tip of the arm 132 has reached the loading position P13 (step S9). In a case where the position of the tip of the arm 132 has not reached the loading position P13 (step S9: NO), the movement processing unit 1107 determines whether or not the position of the tip of the arm 132 is in the vicinity of the interference avoidance position P12. For example, the movement processing unit 1107 determines whether or not a difference between the height of the tip of the arm 132 and the height of the interference avoidance position P12 is less than a predetermined threshold value, or a difference between the plane distance from the center of swing of the swing body 120 to the tip of the arm 132 and the plane distance from the center of swing to the interference avoidance position P12 is less than a predetermined threshold value (step S10). In a case where the position of the tip of the arm 132 is not in the vicinity of the interference avoidance position P12 (step S10: NO), the movement processing unit 1107 generates the operation signal of the boom 131 and the arm 132 that moves the tip of the arm 132 to the interference avoidance position P12 (step S11). At this time, the movement processing unit 1107 generates the operation signal based on the positions and speeds of the boom 131 and the arm 132.

In addition, the movement processing unit 1107 calculates the sum of the angular velocities of the boom 131 and the arm 132 based on the generated operation signals of the boom 131 and the arm 132, and generates the operation signal for rotating the bucket 133 at the same speed as the sum of the angular velocities (step S12). Accordingly, the movement processing unit 1107 can generate the operation signal for holding the ground angle of the bucket 133. In another embodiment, the movement processing unit 1107 may generate the operation signal for rotating the bucket 133 such that the ground angle of the bucket 133 obtained by calculating from the detected values of the boom angle sensor 137, the arm angle sensor 138, and the bucket angle sensor 139 becomes equal to the ground angle when the automatic control is started.

In a case where the position of the tip of the arm 132 is in the vicinity of the interference avoidance position P12 (step S10: YES), the movement processing unit 1107 does not generate operation signals of the boom 131, the arm 132, and the bucket 133.

The movement processing unit 1107 determines whether or not the swing speed of the swing body 120 is lower than a predetermined speed based on the vehicle information acquired by the vehicle information acquisition unit 1101 (step S13). In other words, the movement processing unit 1107 determines whether or not the swing body 120 is swing.

In a case where the swing speed of the swing body 120 is lower than the predetermined speed (step S13: YES), the movement processing unit 1107 specifies a rise time which is time for the height of the bucket 133 to reach the height of the interference avoidance position P12 from the height of the excavation completion position P10 (step S14). In a case where the swing operation signal is output at the current timing based on the rise time of the bucket 133, the movement processing unit 1107 determines whether or not the tip of the arm 132 passes through the interference avoidance position P12 or a point higher than the interference avoidance position P12 (step S15). In a case where the swing operation signal is output at the current timing, and in a case where the tip of the arm 132 passes through the interference avoidance position P12 or the point higher than the interference avoidance position P12 (step S15: YES), the movement processing unit 1107 generates the swing operation signal for controlling the opening of the direction control valve 704 to the maximum opening (step S16).

In a case where the swing operation signal is output at the current timing, and in a case where the tip of the arm 132 passes through a point lower than the interference avoidance position P12 (step S15: NO), the movement processing unit 1107 does not generate the swing operation signal.

In a case where the swing speed of the swing body 120 is equal to or higher than a predetermined speed (step S13: NO), the remaining swing angle specification unit 1108 specifies the remaining swing angle for stopping at the target stopping azimuth direction, from the difference between the azimuth direction in which the swing body 120 currently faces and the target stopping azimuth direction (step S17). In addition, the inertia specification unit 1109 specifies the moment of inertia in the swing of the swing body 120 around the center of swing (step S18).

Next, based on the current swing speed of the swing body 120 and the remaining swing angle, the braking start determination unit 1110 determines whether or not the angle for swing the swing body 120 until stop becomes equal to or greater than the remaining swing angle when the swing motor 703 decelerates at a deceleration that corresponds to a temporary target pressure that is smaller than the relief pressure of the second relief valve 710 (step S19). The braking start determination unit 1110 determines to start the braking of the swing motor 703 in a case where the swing angle until stop becomes equal to or greater than the remaining swing angle (step S19: YES).

When the braking start determination unit 1110 determines to start the braking of the swing motor 703, the target deceleration specification unit 1111 specifies the target deceleration for the swing body 120 to stop in the target stopping azimuth direction based on the current swing speed of the swing body 120 and the remaining swing angle (step S20). Next, the target pressure determination unit 1112 determines a target pressure of the hydraulic device 127 for achieving the target deceleration based on the target deceleration (step S21). Based on the target pressure, the back pressure control unit 1113 determines the opening area on the downstream side of the swing motor 703 of the direction control valve 704 for achieving the target pressure (step S22). The back pressure control unit 1113 generates the operation signal for controlling the direction control valve 704 to the determined opening area (step S23).

When at least one of the rotation operation signals of the boom 131, the arm 132, and the bucket 133 and the operation signal of the direction control valve 704 is generated by the processing from step S9 to step S23, the operation signal output unit 1114 outputs the generated operation signal to the hydraulic device 127 (step S24).

Then, the vehicle information acquisition unit 1101 acquires the vehicle information (step S25). Accordingly, the vehicle information acquisition unit 1101 can acquire the vehicle information after operating by the output operation signal. The control device 128 returns the process to step S9, and repeatedly executes the operation signal.

On the other hand, in a case where the position of the tip of the arm 132 has reached the loading position P13 in step S9 (step S9: YES), the movement processing unit 1107 generates the operation signal that causes the bucket 133 to perform a loading operation (step S26). Examples of the operation signal for causing the bucket 133 to perform the loading operation include an operation signal for rotating the bucket 133 in a soil removal direction and an operation signal for opening the clam shell in a case where the bucket 133 is a clam bucket. The operation signal output unit 1114 outputs the generated operation signal to the hydraulic device 127 (step S27). Then, the control device 128 ends the automatic loading control.

<<Action and Effect>>

In this manner, during braking of the swing motor 703, the control device 128 according to the first embodiment generates the operation signal for controlling the pressure of the hydraulic oil on the downstream side of the swing motor 703 in the hydraulic device 127 based on the azimuth direction, the swing speed, and the target stopping azimuth direction of the swing body 120. Accordingly, the control device 128 can appropriately control the braking force of the swing motor 703 while the swing body 120 is swing, and can control the swing body 120 to stop toward the target stopping azimuth direction.

In addition, the control device 128 according to the first embodiment starts braking of the swing motor 703 at the timing when the swing body 120 stops toward the target stopping azimuth direction in a case where the hydraulic device 127 brakes with a target pressure less than the relief pressure. Accordingly, the control device 128 can increase the target pressure to the relief pressure. In other words, the control device 128 can perform control such that the swing body 120 is stopped toward the target stopping azimuth direction by increasing the target pressure and increasing the deceleration of the swing body 120 even in a case where the timing of the braking start is extremely delayed by determining the braking start timing of the swing motor 703 based on the target pressure less than the relief pressure. Further, even in a case where the timing of braking start is extremely early, the swing body 120 can be controlled to be stopped toward the target stopping azimuth direction by decreasing the target pressure and decreasing the deceleration of the swing body 120.

Second Embodiment

The control device 128 according to the first embodiment controls the deceleration of the swing body 120 by generating the operation signal for changing the opening area on the downstream side of the swing motor 703 of the direction control valve 704. On the other hand, the control device 128 according to the second embodiment controls the deceleration of the swing body 120 by changing the relief pressure of the second relief valve 710.

<<Configuration of Hydraulic Device>>

Figure 8:
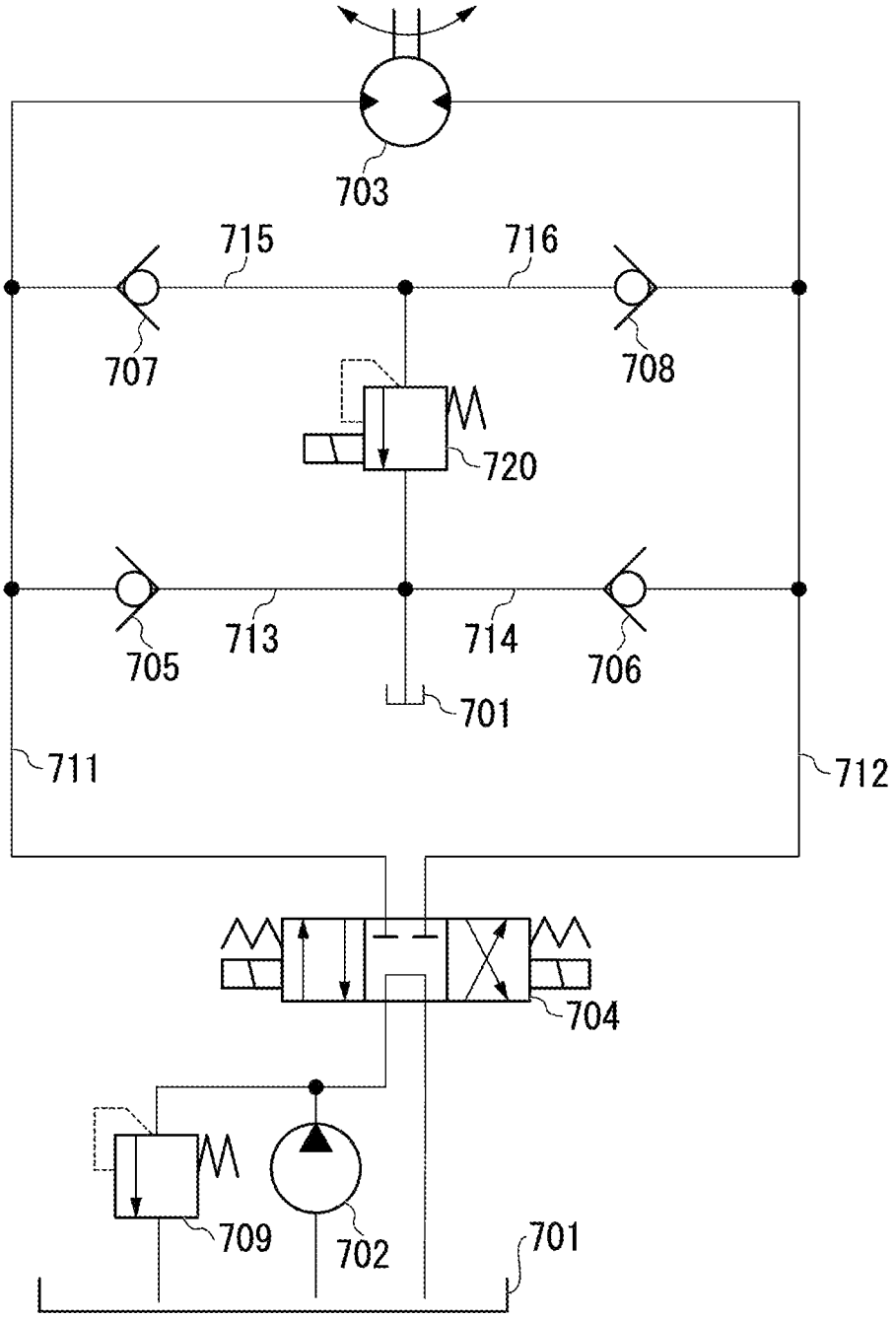
FIG. 8 is a schematic block diagram showing a configuration that contributes to swing of a swing body in a hydraulic device according to a second embodiment.

FIG. 8 is a schematic block diagram showing a configuration that contributes to the swing of the swing body in the hydraulic device according to the second embodiment.

The hydraulic device 127 according to the second embodiment includes a variable relief valve 720 instead of the second relief valve 710 of the first embodiment.

The variable relief valve 720 is a relief valve that can change the relief pressure in accordance with the operation signal from the control device 128. In other words, when the solenoid of the variable relief valve 720 is excited by the operation signal, the relief pressure of the variable relief valve 720 decreases. The variable relief valve 720 is provided between the third branch pipe line 715 and the fourth branch pipe line 716 and the hydraulic oil tank 701, and discharges the hydraulic oil to the hydraulic oil tank 701 when the pressure applied to the variable relief valve 720 becomes equal to or higher than the set relief pressure by the operation signal.

<<Configuration of Control Device>>

The control device 128 according to the second embodiment is different from the first embodiment in the operations of the braking start determination unit 1110, the back pressure control unit 1113, and the operation signal output unit 1114.

The braking start determination unit 1110 determines to start braking of the swing motor 703 in a case where the swing angle of the swing body 120 until stop becomes equal to or greater than the remaining swing angle when decelerating at a deceleration that corresponds to the temporary target pressure while considering the temporary target pressure as, for example, a median value between the lowest relief pressure and the highest relief pressure of the variable relief valve 720. Here, the median value between the lowest relief pressure and the highest relief pressure may not be necessarily a median value that equally divides the lowest relief pressure and the highest relief pressure, and may be a value between the lowest relief pressure and the highest relief pressure.

The back pressure control unit 1113 generates the operation signal for making the relief pressure of the variable relief valve 720 to the pressure determined by the target pressure determination unit 1112 instead of acquiring the operation signal for controlling the opening area A on the downstream side of the swing motor 703 in the direction control valve 704.

The operation signal output unit 1114 can change the relief pressure of the variable relief valve 720 by outputting the operation signal generated by the back pressure control unit 1113 to the variable relief valve 720.

<<Operation>>

Figure 9:
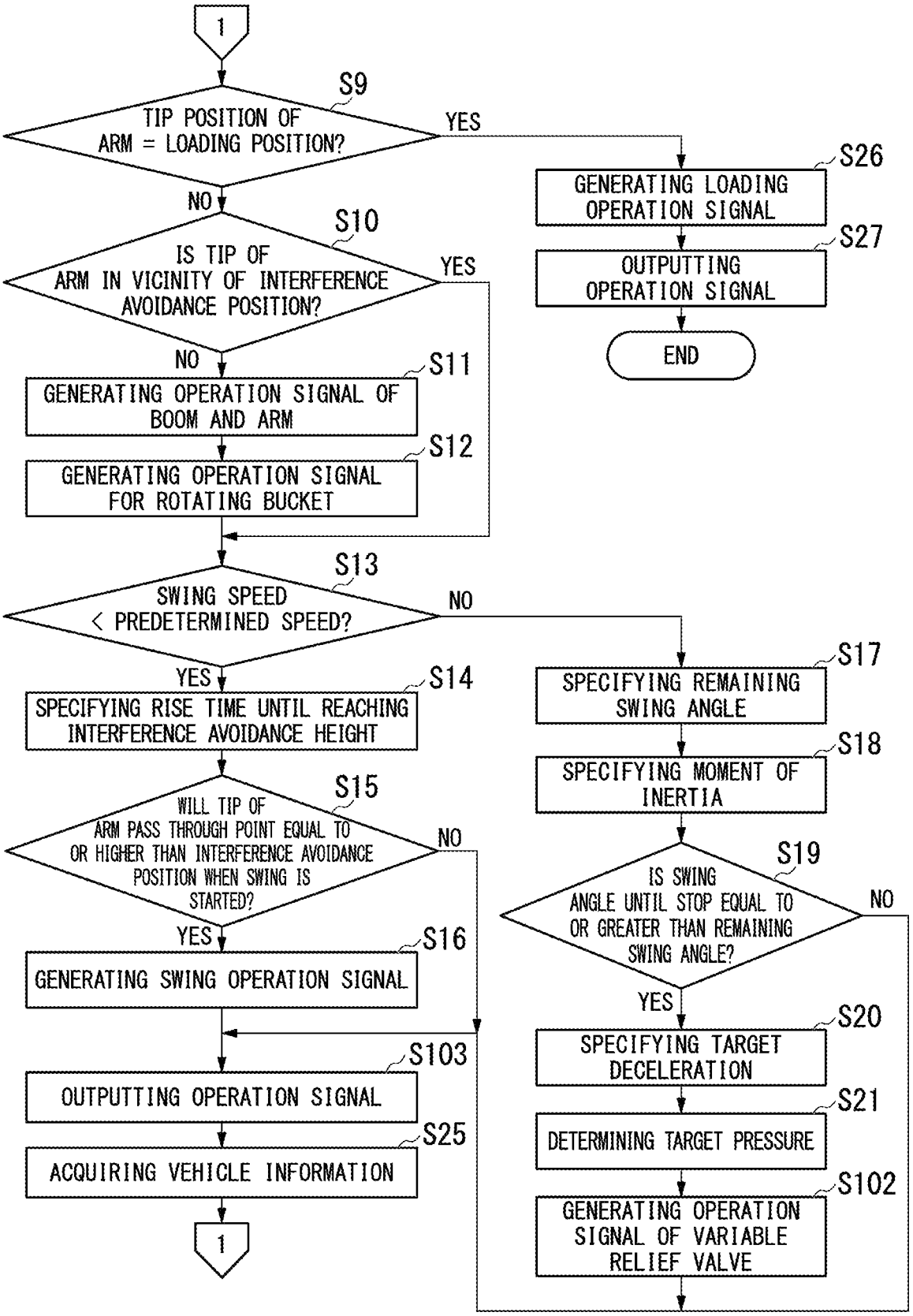
FIG. 9 is a flowchart showing an automatic loading control method according to the second embodiment.

FIG. 9 is a flowchart showing an automatic loading control method according to the second embodiment. When the control device 128 receives the input of the loading command signal from the operator, the control device 128 executes the processing from step S1 to step S13 similar to the first embodiment.

In step S13, in a case where the swing speed of the swing body 120 is equal to or higher than a predetermined speed (step S13: NO), the remaining swing angle specification unit 1108 specifies the remaining swing angle for stopping at the target stopping azimuth direction, from the difference between the azimuth direction in which the swing body 120 currently faces and the target stopping azimuth direction (step S17). In addition, the inertia specification unit 1109 specifies the moment of inertia in the swing of the swing body 120 around the center of swing (step S18).

Next, based on the current swing speed and the remaining swing angle of the swing body 120, the braking start determination unit 1110 determines whether or not the swing angle of the swing body 120 until stop becomes equal to or greater than the remaining swing angle when the swing motor 703 decelerates at a deceleration that corresponds to a median temporary target pressure between the lowest relief pressure and the highest relief pressure of the variable relief valve 720 (step S19). The braking start determination unit 1110 determines to start the braking of the swing motor 703 in a case where the swing angle until stop becomes equal to or greater than the remaining swing angle (step S19: YES).

When the braking start determination unit 1110 determines to start the braking of the swing motor 703, the target deceleration specification unit 1111 specifies the target deceleration for the swing body 120 to stop in the target stopping azimuth direction based on the current swing speed of the swing body 120 and the remaining swing angle (step S20). Next, the target pressure determination unit 1112 determines a target pressure of the hydraulic device 127 for achieving the target deceleration based on the target deceleration (step S21). The back pressure control unit 1113 generates the operation signal for setting the relief pressure of the variable relief valve 720 to the determined target pressure (step S102).

Then, the operation signal output unit 1114 outputs the generated operation signal to the hydraulic device 127 (step S103). At this time, the operation signal output unit 1114 outputs the operation signal generated by the back pressure control unit 1113 to the variable relief valve 720.

Thereafter, the control device 128 performs the same processing as in the first embodiment.

<<Action and Effect>>

In this manner, during braking of the swing motor 703, the control device 128 according to the second embodiment generates the operation signal for controlling the relief pressure of the variable relief valve 720 based on the azimuth direction, the swing speed, and the target stopping azimuth direction of the swing body 120. Accordingly, similar to the first embodiment, the control device 128 can appropriately control the braking force of the swing motor 703 while the swing body 120 is swing, and can control the swing body 120 to stop toward the target stopping azimuth direction.

In addition, the control device 128 according to the second embodiment starts braking of the swing motor 703 at the timing when the swing body 120 stops toward the target stopping azimuth direction in a case where the hydraulic device 127 brakes with a median pressure between the lowest relief pressure and the highest relief pressure. Accordingly, the control device 128 can perform control such that the swing body 120 is stopped toward the target stopping azimuth direction by outputting the operation signal that increases the relief pressure of the variable relief valve and increasing the deceleration of the swing body 120 even in a case where the timing of the braking start is extremely delayed. In addition, control can be performed such that the swing body 120 is stopped toward the target stopping azimuth direction by outputting the operation signal that decreases the relief pressure of the variable relief valve and decreasing the deceleration of the swing body 120 even in a case where the timing of the braking start is extremely early.

Above, the embodiment has been described in detail with reference to the drawings, but the specific configuration is not limited to the above-described configuration, and various design changes can be made.

For example, the control device 128 according to the above-described embodiment controls any one of the opening area of the direction control valve 704 and the relief pressure of the variable relief valve 720, but is not limited thereto. For example, the control device 128 according to another embodiment controls the opening area of the direction control valve 704 in a case where the deceleration is extremely high, and controls the relief pressure of the direction control valve 704 in a case where the deceleration is extremely small.

Moreover, although the loading machine 100 according to the first embodiment is a manned driving vehicle which an operator boards and operates, but the invention is not limited thereto. For example, the loading machine 100 according to another embodiment may be a remotely operated vehicle that is operated by an operation signal acquired by communication from a remote operation device that is operated by an operator in a remote office while looking at a monitor screen. In this case, some functions of the control device 128 may be provided in the remote operation device.

INDUSTRIAL APPLICABILITY

In the control device according to the present invention, it is possible to accurately control the azimuth direction in which the swing body faces when swing is stopped.

REFERENCE SIGNS LIST

100 . . . loading machine
110 . . . traveling body
120 . . . swing body
123 . . . operation device
125 . . . position and azimuth direction calculator
126 . . . inclination measuring device
127 . . . hydraulic device
128 . . . control device
130 . . . work equipment
131 . . . boom
132 . . . arm
133 . . . bucket
134 . . . boom cylinder
135 . . . arm cylinder
136 . . . bucket cylinder
701 . . . hydraulic oil tank
702 . . . hydraulic pump
703 . . . swing motor
704 . . . direction control valve
709 . . . first relief valve
710 . . . second relief valve
720 . . . variable relief valve
1101 . . . vehicle information acquisition unit
1102 . . . detection information acquisition unit
1103 . . . operation signal input unit
1104 . . . bucket position specification unit
1105 . . . loading position specification unit
1106 . . . avoidance position specification unit
1107 . . . movement processing unit
1108 . . . remaining swing angle specification unit
1109 . . . inertia specification unit
1110 . . . braking start determination unit
1111 . . . target deceleration specification unit
1112 . . . target pressure determination unit
1113 . . . back pressure control unit
1114 . . . operation signal output unit

The invention claimed is:

1. A control device of a loading machine including a hydraulic device having a swing motor that is rotated by hydraulic oil, and a relief valve that discharges the hydraulic oil when a pressure of the hydraulic oil becomes equal to or higher than a relief pressure, and a swing body that swings around a center of swing by rotation of the swing motor, the control device comprising:

a back pressure control unit that is configured to generate an operation signal for controlling the pressure of the hydraulic oil on a downstream side of the swing motor in the hydraulic device based on an azimuth direction, a swing speed, and a target stopping azimuth direction of the swing body during braking of the swing motor;

a braking start determination unit that is configured to determine to start braking of the swing motor at a timing when the azimuth direction in which the swing body faces is stopped at the target stopping azimuth direction in a case where the pressure of the hydraulic oil on the downstream side of the swing motor is maintained at a predetermined pressure; and an operation signal output unit that is configured to output the operation signal of the back pressure control unit to the hydraulic device.

2. The control device according to claim 1, wherein the braking start determination unit is configured to determine to start the braking of the swing motor at the timing when the azimuth direction in which the swing body faces is stopped at the target stopping azimuth direction in a case where the hydraulic device brakes at a target pressure less than the relief pressure.

3. The control device according to claim 2, wherein the hydraulic device includes a main valve that controls a flow rate of the hydraulic oil supplied to the swing motor, and wherein the back pressure control unit generates the operation signal for controlling the pressure of the hydraulic oil by changing an opening area which allows a flow with the flow rate of the hydraulic oil on the downstream side of the swing motor in the main valve.

4. The control device according to claim 2, wherein the relief valve is a variable relief valve that is capable of changing the relief pressure with the operation signal, and wherein the back pressure control unit generates the operation signal for controlling the pressure of the hydraulic oil on the downstream side of the swing motor by changing the relief pressure of the relief valve.

5. The control device according to claim 1, wherein the hydraulic device includes a main valve that controls a flow rate of the hydraulic oil supplied to the swing motor, and wherein the back pressure control unit generates the operation signal for controlling the pressure of the hydraulic oil by changing an opening area which allows a flow with the flow rate of the hydraulic oil on the downstream side of the swing motor in the main valve.

6. The control device according to claim 1, wherein the relief valve is a variable relief valve that is capable of changing the relief pressure with the operation signal, and wherein the back pressure control unit generates the operation signal for controlling the pressure of the hydraulic oil on the downstream side of the swing motor by changing the relief pressure of the relief valve.

7. A control method of a loading machine including a hydraulic device having a swing motor that is rotated by hydraulic oil, and a relief valve that discharges the hydraulic oil when a pressure of the hydraulic oil becomes equal to or higher than a relief pressure, and a swing body that swings around a center of swing by rotation of the swing motor, the control method comprising the steps of:

generating an operation signal for controlling the pressure of the hydraulic oil on a downstream side of the swing motor in the hydraulic device based on an azimuth direction, a swing speed, and a target stopping azimuth direction of the swing body during braking of the swing motor; and determining to start braking of the swing motor at a timing when the azimuth direction in which the swing body faces is stopped at the target stopping azimuth direction in a case where the pressure of the hydraulic oil on the downstream side of the swing motor is maintained at a predetermined pressure; and outputting the operation signal to the hydraulic device.

* * * * *